United States Patent [19]

Posnick

[11] 4,000,528

[45] Jan. 4, 1977

[54] WHIRLPOOL TUB AND METHOD OF MAKING SAME

[76] Inventor: Irving H. Posnick, c/o Aqualand Pool Co., Inc. 3400 Dakota Ave. South, Minneapolis, Minn. 55416

[22] Filed: Mar. 10, 1975

[21] Appl. No.: 556,684

[52] U.S. Cl. ..... 4/180; 156/253

[51] Int. Cl.[2] ..... A61H 33/02

[58] Field of Search ..... 4/173, 178, 180, 181, 4/172.17, 172.15; 128/66, 369; 156/253

[56] References Cited

UNITED STATES PATENTS

| | | | |
|---|---|---|---|
| 2,856,611 | 10/1958 | Velonis | 4/180 |
| 3,251,071 | 5/1966 | Wood | 4/180 |
| 3,467,969 | 9/1969 | Szekely | 4/180 |

FOREIGN PATENTS OR APPLICATIONS

| | | | |
|---|---|---|---|
| 387,879 | 3/1965 | Switzerland | 4/178 |

*Primary Examiner*—Richard E. Aegerter
*Assistant Examiner*—Stuart S. Levy
*Attorney, Agent, or Firm*—Burd, Braddock & Bartz

[57] ABSTRACT

A whirlpool tub for relaxation or hydrotherapeutic use characterized by a synthetic resinous shell having a plurality of spaced apart apertures in the bottom wall in communication with an air distribution channel formed in the rigidifying backing board conventionally used in plastic bathtubs. The channel in the backing board is connected to an air inlet which in turn is adapted for connection to a source of air under pressure. The method of manufacturing such a tub in which the air distribution channels are disposed within the backing board permits simplified manufacturing techniques compatible with existing mass production practices by which bathtubs are currently produced.

11 Claims, 6 Drawing Figures

WHIRLPOOL TUB AND METHOD OF MAKING SAME

This invention relates to whirlpool tubs and a simplified economical method of manufacturing the same. The invention relates to whirlpool tubs of the type having a plurality of spaced apart apertures in the tub wall through which air under pressure is forced through a liquid contained in the tub to agitate and circulate the liquid to produce massaging stimulating air bubbles for hydrotherapeutic purposes or simply for the soothing relaxing effect produced on the body or a body member by such action.

Most plastic bathtubs are manufactured by the so-called form-and-spray technique by which a thin-gauge thermo-formed acrylic sheet is rigidized and stiffened by the application of one or more layers of reinforced polyester. The manufacture of bathtubs and similar plumbing fixtures by this technique is described in Wimmer U.S. Pat. No. Re. 27,430 and an article appearing in Modern Plastics for August 1972 at pages 44–45, the disclosures of both of which are incorporated herein by reference. Although the glass fiber reinforced polyester coating applied to the back of the formed acrylic sheet imparts strength and rigidity to the plumbing fixture, it is common practice in the case of large vessels such as bathtubs to further strengthen and rigidize the tub by affixing a rigid backing board, such as chipboard, to the bottom of the tub.

The principal object of the present invention is to provide a whirlpool tub and method of manufacture utilizing the rigid reinforcing backing board of a tub to carry air distribution channels for converting the tub to whirlpool use.

The invention is illustrated in the accompanying drawings in which.

Figure 1:
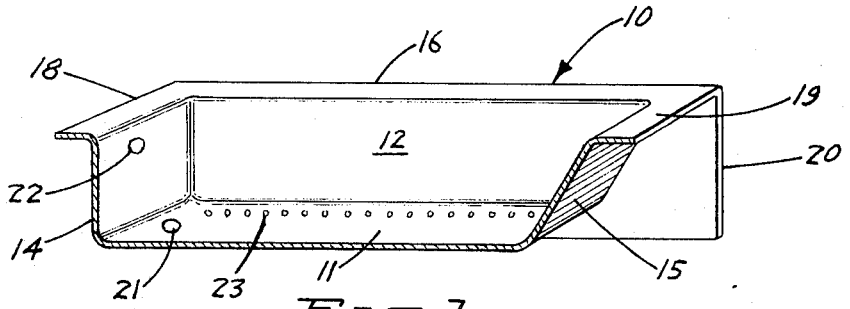
FIG. 1 is an isometric view of a typical form of plastic bathtub shown in longitudinal section and adapted for whirlpool use.

Referring now to the drawings, in FIG. 1 there is shown in section a whirlpool bath, indicated generally at 10, according to the present invention. The tub is of conventional design having a bottom wall 11, vertical side walls 12 and 13, a vertical end wall 14, and sloping end wall 15. A continuous rim or lip surrounds the open top of the tub with lip segments 16–19 extending outwardly from side and end walls 12–15, respectively. Depending upon the proposed location of the bathtub in use, one or more sides or ends of the tub are provided with a vertical skirt 20 depending from the corresponding lip and extending to the floor. In this instance, where the tub is adapted for installation in a bathroom recess having walls on three sides, the skirt 20 depends downwardly from lip 16 extending along the top edge of side wall 12. Skirt 20 extends generally parallel to side wall 12 for a distance slightly greater than the depth of the tub. Upon installation, skirt 20 partially supports the tub with bottom wall 11 spaced from the floor of the room in which the tub is installed.

A drain hole 21 is provided adjacent one end of the tub. The depth of the tub is less adjacent sloping end wall 15 than at the opposite end so as to impart a slight slope in bottom wall 11 toward drain hole 21 to facilitate drainage from the tub. An overflow drain hole 22 is provided in end wall 14 adjacent to its upper edge. A plurality of air apertures 23 are provided in bottom wall 11 in any desired pattern, each aperture communicating with an air distribution channel, as described in greater detail hereinafter.

A tub liner shell **10*a* having the configuration generally as described above, apart from the holes and apertures therein, is formed on standard thermo-forming equipment from an acrylic resin such as Swedcast 300 (Swedlow Inc., Garden Grove, Calif.) or Plexiglass K (Rohm & Hass, Philadelphia, Penn.), or the like. The shell liner is normally between 80 and 250 mils in thickness. After cleaning to assure proper adhesion, the back side of the shell is spray-coated with a layer 10*b*** of chopped glass fibers and polyester resin. The polyester formulation typically contains 20 to 25 percent glass and 2 percent of glass or plastic microspheres. Two backup coatings are generally applied.

Figure 2:
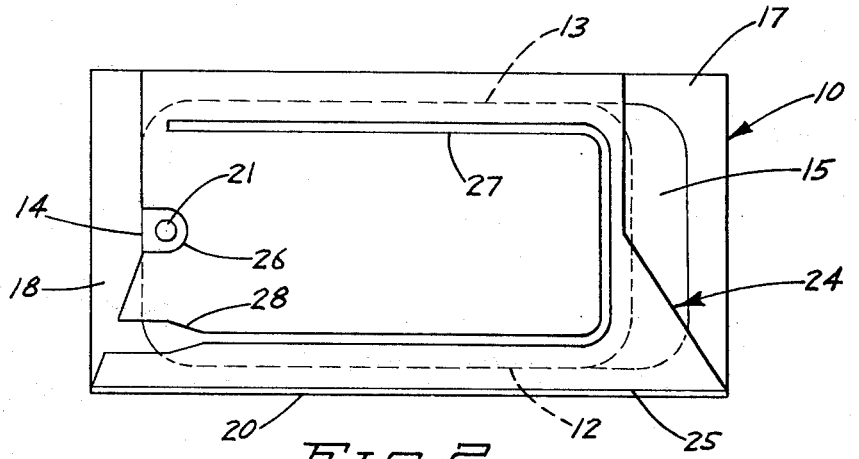
FIG. 2 is a bottom plan view of a reinforced plastic bathtub shown with a stiffening backing board affixed to the bottom of the tub and provided with an air distribution channel.
Figure 3:
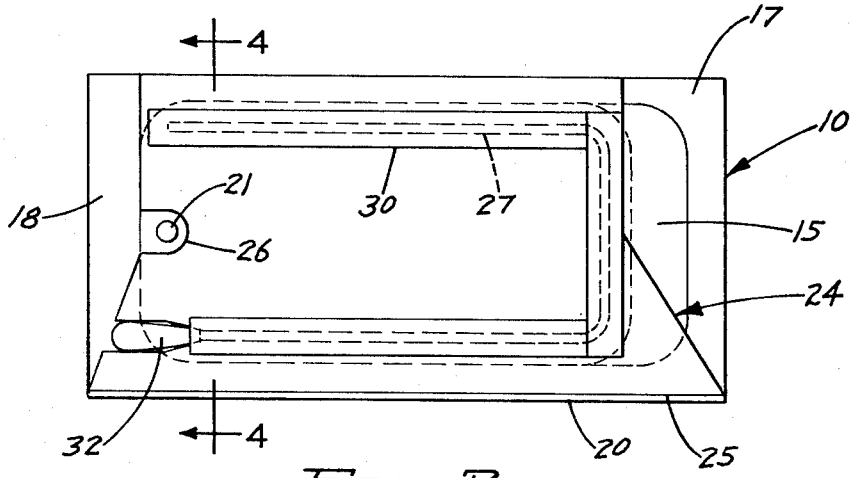
FIG. 3 is a similar bottom plan view subsequent to the enclosing of the air distribution channel and attachment of an air inlet.

As seen in FIGS. 2 and 3, a rigid stiffening back board, indicated generally at 24, is pressed into place against the bottom wall of the tub after the application of the first coating, before is has set up and hardened, to adhesively affix the back board to the tub. Thereafter, the second reinforced polyester resin backup coating is applied. A typical backup material having the required rigidity and strength is 1 inch plastic bonded wood chipboard. Side edge 25 of the backup board 24 is coextensive with and butted up against the inside surface of skirt 20. To reduce weight, the ends of the backing board are commonly cut away, as illustrated. A recess 26 is provided to permit access to drain hole 21.

According to the present invention, an elongated air distribution channel 27 is formed in backing board 24. A somewhat larger air inlet recess 28 is likewise formed in the backing board in communication with the air distribution channel. The air distribution channel 27 extends through the thickness of the backing board 24 so that, when the backing board is in place against the bottom wall of the tub, that bottom wall is exposed. The air distribution channel and recess for the air inlet may be formed in the backing board by routing after the backing board has been secured in place. Preferably, however, the air distribution channel and air inlet recess are formed in the backing board prior to placement of that board. For example, these elements may be formed simultaneously in a plurality of backing boards by cutting the desired pattern in a stack of backing boards, as with a band saw.

If the air distribution channel is precut, the backing board is affixed to the bottom of the tub in the conventional manner after application of the first polyester spray coat before that coating has set up and hardened, to adhesively secure the backing board to the tub. Then an additional sealing coat, desirably of the same polyester resin, is applied over and around the air distribution channel 27 and recess 28 for the air inlet in order to insure a leak-proof connection between the backing board and tub bottom wall. Thereafter, while the sealing coat is still unset and unhardened, a covering sheet or plate 30 is laid over the air distribution channel and secured to the backing board. This covering 30 for the channel 27 may be light gauge strips of metal, so-called duct tape, or the like.

Figure 6:
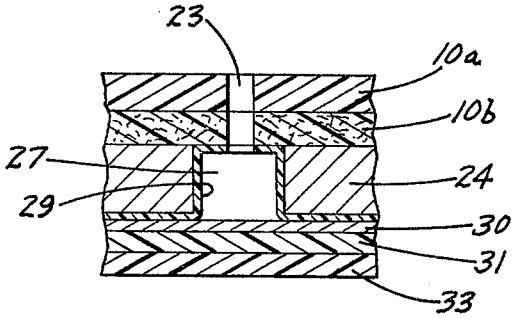
FIG. 6 is an enlarged transverse section through the air distribution channel showing details of construction.

A further plastic sealing coat 31, preferably polyester resin, is applied over and around the covering 30 to insure a fluid-tight seal over the air distribution channel. An air inlet fitting or nozzle 32 is cemented into the recess 28 provided for that purpose in the backing board. Thereafter, the conventional chopped glass-polyester resin second spray backup coat is applied in the usual manner. The detailed structure of the air distribution channel 27, its plastic liner or seal coat 29, covering 30, seal coat 31, and overlying spray coat 33 are shown in the enlarged fragmentary detailed sectional view in FIG. 6.

When the backing board is affixed to the bottom wall of the tub prior to forming of the air distribution channel, generally the same procedure is followed. After the channel 27 has been routed out, the liner or seal coat 29 is applied. Thereafter, the procedure is as already described.

A plurality of spaced apart apertures are formed by drilling through the bottom of the tub in a pattern corresponding to that of the air distribution channel 27. Any suitably template or jig may be used to insure accurate placement of the apertures 23. As illustrated, the apertures are in a generlly U-shaped pattern extending along the opposite sides and back end wall of the tub. Any other pattern or configuration of apertures may be used so long as the pattern of the air distribution channel corresponds.

Figure 4:
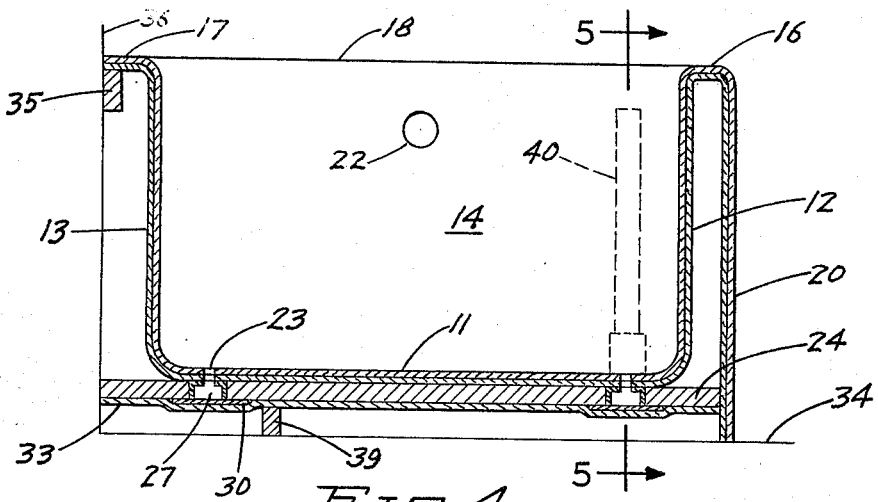
FIG. 4 is a transverse section of the tub of FIG. 3 taken on the line 4-4 and in the direction of the arrows, shown partially installed.
Figure 5:
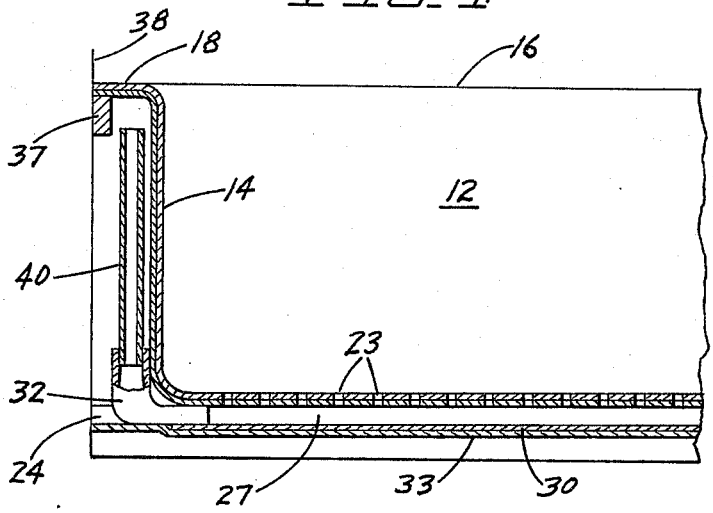
FIG. 5 is a fragmentary longitudinal section on the line 5—5 of FIG. 4 and in the direction of the arrows.

As seen in FIGS. 4 and 5, when the tub is installed in a bathroom recess, the free edge of skirt 20 rests upon the floor surface 34. Side lip 17 rests upon a beam 35 supported from wall 36. End lip 18 is supported from beam 37 secured to the bathroom recess end wall 38. The opposite end of the tub is similarly supported. To provide further support, a longitudinal beam 39 extends between the floor and the bottom of the backing board. Supporting beam 39 is slightly tapered at an angle corresponding to the slop of the bottom wall of the tub.

A standpipe 40 is fit in fluid-tight relation to the air inlet nozzle fitting 32 to a height higher than the overflow drain so as to avoid the possibility of any accidental leakage of water from the tub when air is not being introduced through the apertures and air distribution channel. A suitable fitting is secured to the top end of standpipe 40 to permit connection to any suitable source of air under pressure, such as the air exhaust of a vacuum cleaning system, an air pump, or the like. For convenience, the air connection is desirably made at the deep end of the tub where the usual water and sewer connections are made. However, the location of the air inlet may be varied as necessary.

As will be understood, when the tub is filled or partially filled with water, and air under pressure is ejected into that water through the air distribution system, the water is agitated. The resulting turbulence stimulates and massages the skin and is relaxing and soothing and helps relieve tension and aches and pains due to sore muscles and the like. Although the invention is described in terms of a full size bathtub, the invention is obviously not limited to any particular size of tub. Smaller sized tubs for hydro-massage of feet, arms, hands, etc., can obviously be made in the same manner.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an eexclusive property or privilege is claimed are defined as follows:

1. A whirlpool tub comprising:

A. an open topped synthetic resinous cavity shell having a bottom wall and side walls and adapted to contain liquid;

B. a rigid backing board adhesively affixed in air- and water-tight sealed relation to the bottom outside wall of said shell;

C. an elongated air distribution channel extending through the thickness of said backing board underlying said bottom wall;

D. an enclosing cover over the bottommost edges of said channel air- and water-tight sealed relation thereto;

E. a plurality of spaced apart apertures extending through the bottom wall of said shell and communicating with said channel; and F. an air inlet in communication with said channel for transmission of air to said apertures.

2. A whirlpool tub according to claim 1 further characterized in that said elongated channel is positioned adjacent to at least a portion of the perimeter of the bottom wall of said tub and said apertures are disposed in a pattern corresponding to that of the channel.

3. A whirlpool tub according to claim 1 further characterized in that a sealing liner is disposed within said channel.

4. A whirlpool tub according to claim 1 further characterized in that said enclosing cover is flat sheet material.

5. A whirlpool tub according to claim 1 further characterized in that a sealing layer is disposed over said enclosing cover.

6. A method of making a whirlpool tub from a formed open topped synthetic resinous cavity shell having a bottom wall and side walls, which method comprises:

A. applying a backup synthetic resinous reinforcing coating to the outer surface of said shell;

B. Adhesively adhering a rigid backing board in air- and water-tight sealed relation to the outside bottom wall of said tub, said backing board having an elongated air distribution channel extending through the thickness of said board;

C. applying an enclosing cover over the bottommost edges of said channel in air- and water-tight sealed relation thereto;

D. forming a plurality of apertures through the bottom wall of said shell and said resinous coating, said apertures communicating with said channel; and E. affixing an air inlet in sealed relation in communication with said channel.

7. A method according to claim 6 further characterized in that:

A. said air distribution channel is formed in said backing board prior to adhering said board to the shell, said channel being in a configuration adapted when adhered to be positioned adjacent to at least a portion of the perimeter of the bottom wall of said tub, and B. said apertures are disposed in a pattern corresponding to that of the channel.

8. A method according to claim 6 further characterized in that:

A. said backing board is first adhered to said shell and said air distribution channel is formed therein by routing, said channel being positioned adjacent to at least a portion of the perimeter of the bottom wall of said tub, and B. said apertures are disposed in a pattern corresponding to that of the channel.

9. A method according to claim 6 further characterized in that a sealing resinous coating is applied to said air distribution channel as a liner.

10. A method according to claim 6 further characterized in that a sealing resinous coating is applied over said enclosing cover.

11. A method according to claim 10 further characterized in that a further backup coating is applied over said sealing coating.

* * * * *

UNITED STATES PATENT AND TRADEMARK OFFICE

CERTIFICATE OF CORRECTION

PATENT NO. : 4,000,528

DATED : January 4, 1977

INVENTOR(S) : Irving H. Posnick

It is certified that error appears in the above-identified patent and that said Letters Patent are hereby corrected as shown below:

Column 2, line 35, "is" should be --it--.

Column 3, line 30, "suitably" should be --suitable--.

Column 3, line 32, "generlly" should be --generally--.

Column 3, line 46, "slop" should be --slope--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*